US007216763B2

(12) United States Patent
Gormick et al.

(10) Patent No.: US 7,216,763 B2
(45) Date of Patent: May 15, 2007

(54) IMPACT PROTECTION SYSTEM FOR CARRYING CASE

(75) Inventors: Todd Michael Gormick, Rancho Santa Margarita, CA (US); David Va, Signal Hill, CA (US); John Krsteski, Huntington Beach, CA (US)

(73) Assignee: Targus, Inc., Anaheim, CA (US)

( * ) Notice: Subject to any disclaimer, the term of this patent is extended or adjusted under 35 U.S.C. 154(b) by 162 days.

(21) Appl. No.: 10/983,623

(22) Filed: Nov. 9, 2004

(65) Prior Publication Data

US 2006/0096822 A1 May 11, 2006

(51) Int. Cl.
*A45C 13/00* (2006.01)
*A45C 13/36* (2006.01)

(52) U.S. Cl. ..... 206/320; 206/523; 190/36; 190/125; 383/109

(58) Field of Classification Search ..... 190/36, 190/125, 127; 206/522, 523, 320, 817, 591; 383/105, 109; 220/632, 920
See application file for complete search history.

(56) References Cited

U.S. PATENT DOCUMENTS 3,136,413 A * 6/1964 Hall ..... 206/305
3,575,781 A * 4/1971 Pezely ..... 428/180
4,044,867 A * 8/1977 Fisher ..... 190/107
4,114,761 A * 9/1978 Kleiner ..... 206/591
4,433,781 A * 2/1984 Hummel ..... 206/314
4,569,082 A * 2/1986 Ainsworth et al. ..... 383/3
4,655,418 A * 4/1987 Melahn ..... 244/138 R
5,010,988 A * 4/1991 Brown ..... 190/104
5,221,005 A * 6/1993 Hayward ..... 206/718
6,059,079 A * 5/2000 Krulik ..... 190/112
6,286,645 B1 * 9/2001 Chen ..... 190/125
2002/0027052 A1 * 3/2002 Godshaw et al. ..... 190/111
2004/0226793 A1 * 11/2004 Tilby et al. ..... 190/125

FOREIGN PATENT DOCUMENTS

JP 03222728 A * 10/1991

* cited by examiner

*Primary Examiner*—Sue A. Weaver
(74) *Attorney, Agent, or Firm*—John R. Thompson; Stoel Rives LLP

(57) ABSTRACT

An impact protection system for a carrying case. The system includes at least one impact protection panel that is inserted in between an exterior side wall and an interior storage compartment of a carrying case, wherein the interior storage compartment is adapted for receiving a portable computer or other delicate instruments or objects. The impact protection panel includes a base portion and an elevated portion and is positioned so that when an impact to the exterior side wall of the case occurs, the force of the impact is first received by the elevated portion and is then distributed via the elevated portion throughout the base portion before impacting a portable computer or other instrument or object stored in the storage compartment of the case.

22 Claims, 6 Drawing Sheets

IMPACT PROTECTION SYSTEM FOR CARRYING CASE

BACKGROUND OF THE INVENTION

1. Field of the Invention

The present invention relates generally to carrying cases. In particular, the present invention relates to carrying cases having means for protecting delicate instruments or objects stored therein against damage from impacts.

2. Background

Portable computers such as laptop or notebook computers have become increasingly popular due to their transportability, allowing such computers to be used in various places during and/or following transport. To enhance transportability, portable computers are typically designed to minimize size and weight and, therefore, do not usually include excess room for accommodating shock or impact absorbing materials or structure to protect sensitive components of the computers against damage from impacts. As a result, portable computers are vulnerable to damage if dropped, bumped against other objects or otherwise jarred or impacted, as often occurs during transport.

When a portable computer is stored in a closed position within a carrying case, it is particularly susceptible to damage from impacts to the side walls of the carrying case. The impact may be brief, such as when the carrying case is dropped on its side or collides with another object, or prolonged, such as when the carrying case is crammed within a crowded overhead bin of an airplane or a trunk of a car for an extended period of time. In either case, a front or back side wall impact can cause the keyboard portion of the portable computer to become pressed up against the display portion of the portable computer, thereby scratching or otherwise damaging the display.

Conventional solutions to this problem generally involve providing a flat layer of padding between the storage compartment of the carrying case that holds the portable computer and a front or rear side wall of the carrying case. However, in practice, such designs have done very little to prevent the damage caused by side impacts as set forth above. What is needed, then, is a system for protecting delicate instruments or objects stored in a carrying case, such as a portable computer, from the damage that may result from side impacts to the case. The desired system should improve upon and address one or more of the shortcomings of conventional impact protection solutions.

BRIEF SUMMARY OF THE INVENTION

An impact protection system in accordance with the present invention includes at least one impact protection panel that is inserted in between an exterior side wall and an interior storage compartment of a carrying case, wherein the interior storage compartment is adapted for receiving a portable computer or other delicate instrument or object. The impact protection panel includes a base portion and an elevated portion and is positioned so that when an impact to the exterior side wall of the case occurs, the force of the impact is first received by the elevated portion and is then distributed via the elevated portion throughout the base portion before impacting a portable computer or other instrument or object stored in the storage compartment of the case.

A carrying case in accordance with one embodiment of the present invention includes an exterior that includes a substantially planar exterior side wall, an interior storage compartment including a substantially planar interior side wall that is parallel to the exterior side wall, and an impact protection panel disposed between the interior side wall and the exterior side wall. The impact protection panel includes a base portion having substantially planar top and bottom surfaces that are parallel to the exterior side wall and the interior side wall. The impact protection panel also includes an elevated portion surrounded by and projecting outward from the top surface of the base portion in the direction of the exterior side wall. In an embodiment, the elevated portion includes a substantially planar elevated surface that is parallel to the top surface of the base portion.

An impact protection panel in accordance with one embodiment of the present invention includes a base portion having substantially planar top and bottom surfaces, and an elevated portion surrounded by and projecting outward from the top surface of the base portion. In an embodiment, the elevated portion includes a substantially planar elevated surface that is parallel to the top surface of the base portion.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention.

Figure 1:
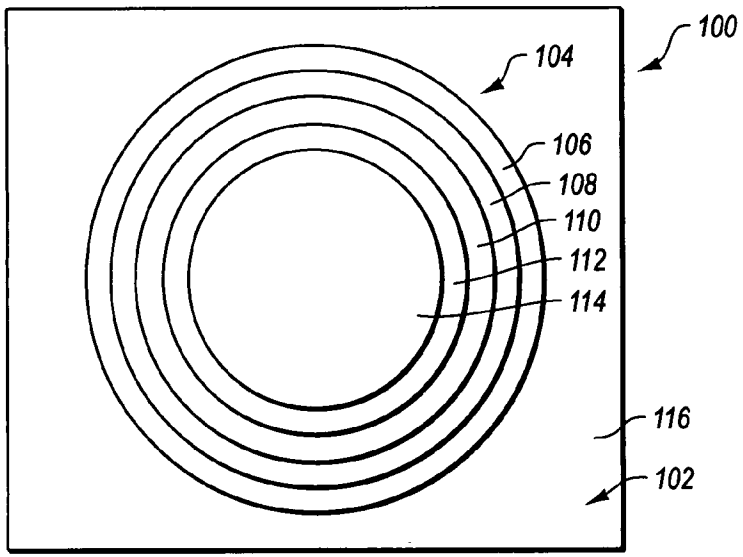
FIG. 1 is a top view of an impact protection panel for use in a carrying case in accordance with an embodiment of the present invention.
Figure 3:
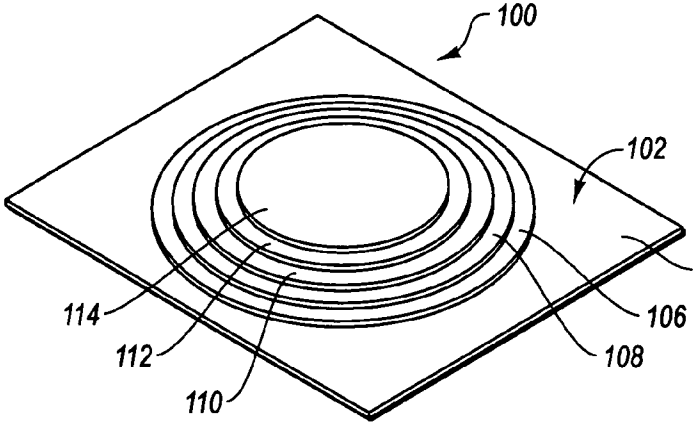
FIG. 3 is a top perspective view of an impact protection panel for use in a carrying case in accordance with an embodiment of the present invention.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawings in which an element first appears is indicated by the leftmost digit(s) in the corresponding reference number.

DETAILED DESCRIPTION OF THE INVENTION

FIGS. 1–4 depict an example impact protection panel 100 for use in a carrying case in accordance with an embodiment of the present invention. In particular, FIGS. 1–4 provide top, side, perspective and cross-sectional views of impact protection panel 100, respectively. As will be described in more detail herein, impact protection panel 100 is adapted for insertion into a carrying case to protect a portable computer or other delicate instruments or objects stored therein from impacts to a front or back side wall of the carrying case.

As shown in FIGS. 1–4, impact protection panel 100 includes a base portion 102 and an elevated portion 104. Base portion 102 includes substantially planar top and bottom surfaces 116 and 118, respectively. Elevated portion 104 is surrounded by and projects outward from top surface 116 of base portion 102. In particular, elevated portion 104 includes a plurality of circular-shaped tiers or steps 106, 108, 110, and 112 projecting outward from top surface 116 of base portion 102 and culminating in a substantially planar elevated surface 114 that is parallel to top surface 116 of base portion 102. Each circular-shaped tier has a smaller diameter than the one beneath it. Elevated surface 114 is circular or disc-shaped and has a surface area that is smaller than the surface area of top surface 116 of base portion 102.

Figure 2:
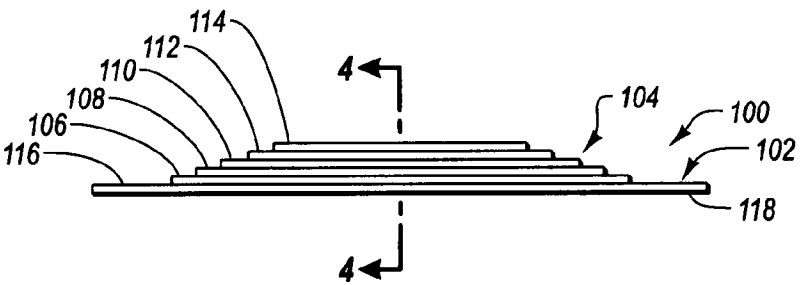
FIG. 2 is a side view of an impact protection panel for use in a carrying case in accordance with an embodiment of the present invention.
Figure 4:
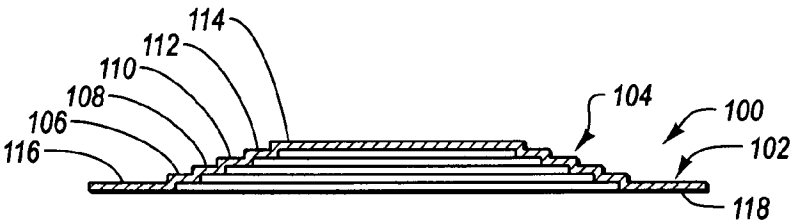
FIG. 4 is a cross-sectional view of an impact protection panel for use in a carrying case in accordance with an embodiment of the present invention.

As shown in FIGS. 2 and 4, elevated portion 104 defines a hollow or concave region that is surrounded by bottom surface 116 of base portion 102. However, in an alternate embodiment (not shown), substantially planar bottom surface 116 of base portion 102 extends underneath the entirety of elevated portion 104 and impact protection panel 100 is solid throughout from bottom surface 116 of base portion 102 to elevated surface 114 of elevated portion 104.

Impact protection panel 100 can be inserted into a carrying case in such a manner that bottom surface 118 of base portion 102 faces into the case and rests directly or indirectly against a flat surface of a portable computer while top surface 116 of base portion 102 faces out of the carrying case. When a side impact to the case occurs, the force of the impact is first received by elevated surface 114 of elevated portion 104 and then, due to the design of impact protection panel 100, is distributed through the tiers of elevated portion 104 and throughout base portion 102 before impacting the portable computer itself. Impact protection panel 100 thus reduces the force that would have otherwise impacted the portable computer, thereby protecting the portable computer from damage.

A critical aspect of the design of impact protection panel 100 is the receiving of the impact by elevated surface 114 of elevated portion 104 and the distribution of the force of the impact to surrounding base portion 102. Persons skilled in the relevant art(s) will readily appreciate that other designs that include an elevated portion 104 having a different size or shape than that depicted in FIGS. 1–4 may be utilized to achieve this result. For example, elevated portion 104 may have more or less tiers than the four tiers shown in FIG. 1–4. Alternatively, elevated portion 104 may have tiers of a different shape than the circular-shaped tiers shown in FIGS. 1–4 including but not limited to oval-shaped, square-shaped, or rectangular-shaped tiers. Furthermore, elevated portion 104 need not have tiers at all, but may instead provide a smooth transition between top surface 116 of base portion 102 and elevated surface 114. These alternative embodiments are also within the scope and spirit of the present invention.

In still alternate embodiments of the present invention, elevated portion 104 does not culminate in a generally planar elevated surface 114 at all but rather culminates in a pointed or rounded surface. Thus, for example, elevated portion 104 may be generally dome-shaped, cone-shaped, or pyramid-shaped. However, these examples are not intended to be limiting and elevated portions having other shapes may be used.

Impact protection panel 100 is preferably composed of a light-weight but strong material providing good impact resistance such as, but not limited to plastic, foam, a polyvinyl chloride (PVC) compound, or other materials exhibiting like properties. Example foam materials include, but are not limited to, thermoplastic foams such as ethylene vinyl acetate (EVA) foam, polyethylene foam, or polypropylene foam.

The thickness of panel 100 as measured from bottom surface 118 of base portion 102 to elevated surface 114 of elevated portion 104 may be as thin as ¼ inch to 1½ inches, although this example range is not intended to be limiting. It will be appreciated, however, that a thin design will conserve space within a carrying case and reduce the overall weight of a carrying case having panel 100 inserted therein.

Figure 5:
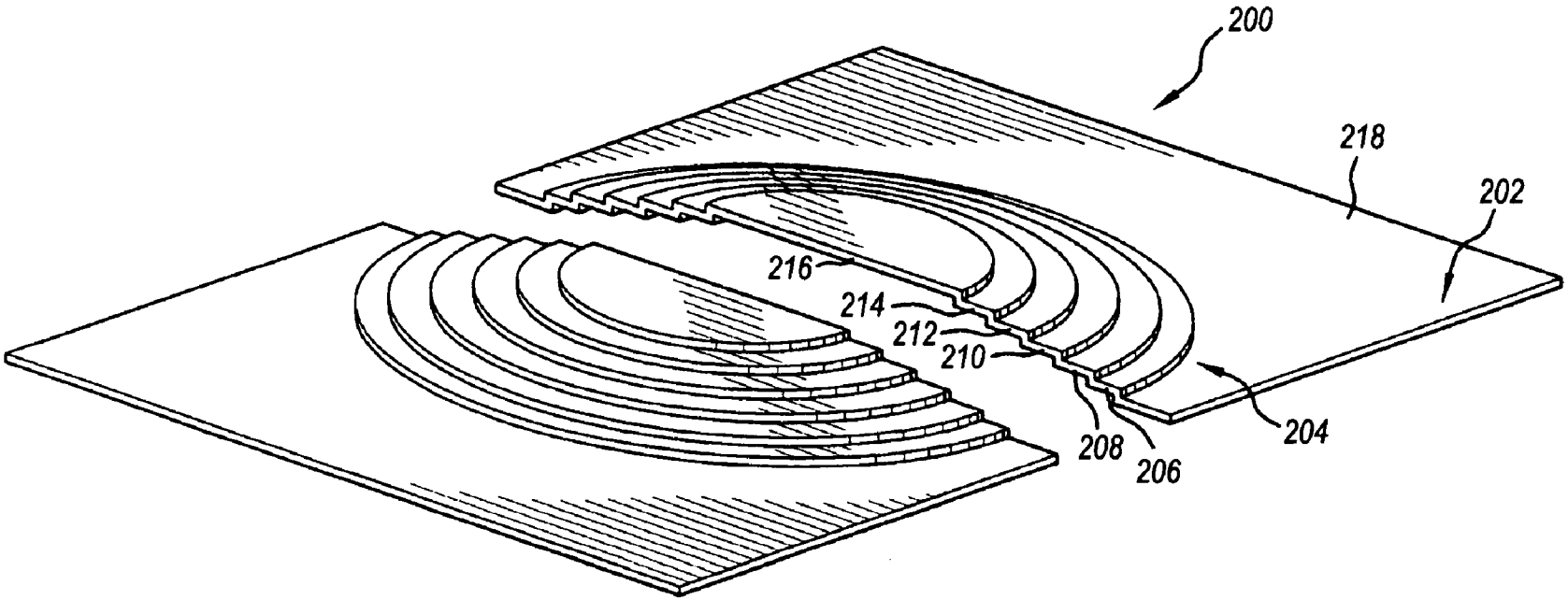
FIG. 5 is a cross-sectional top perspective view of an impact protection panel for use in a carrying case in accordance with an embodiment of the present invention.
Figure 6:
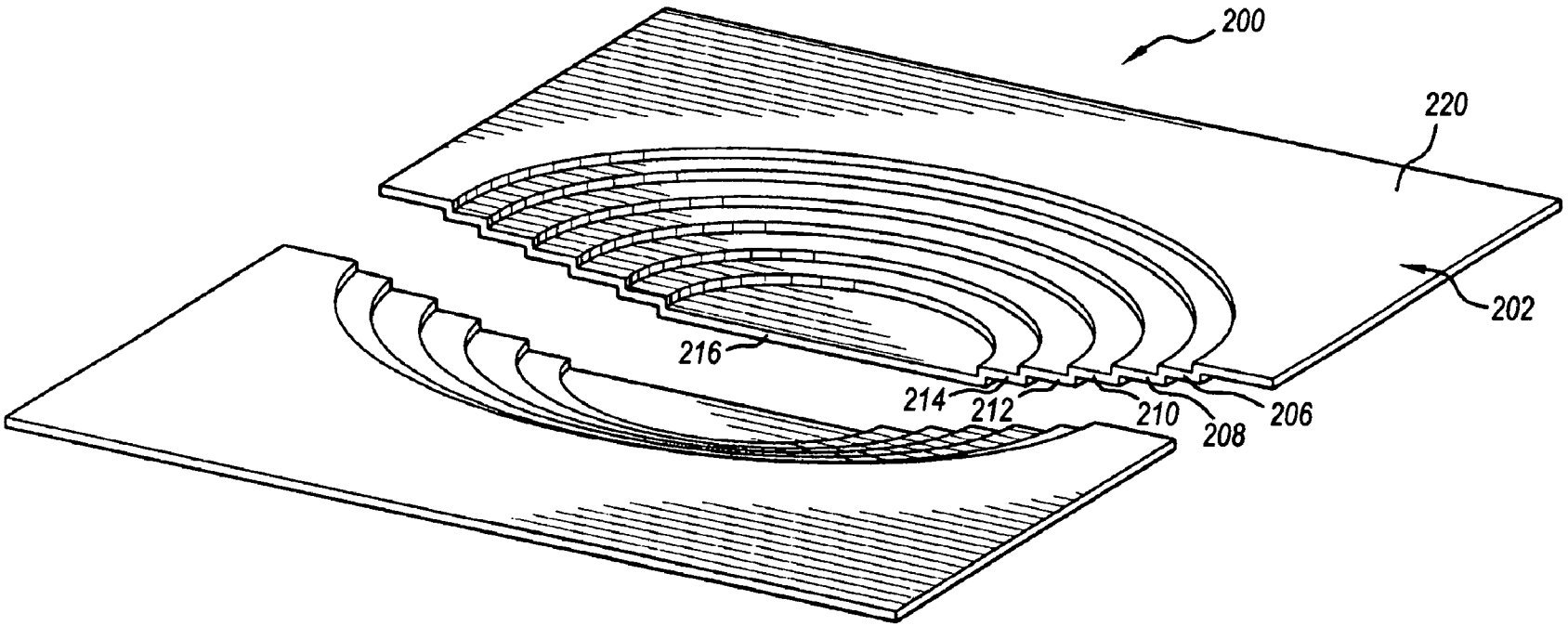
FIG. 6 is a cross-sectional bottom perspective view of an impact protection panel for use in a carrying case in accordance with an embodiment of the present invention

FIGS. 5 and 6 depict cross-sectional perspective views of an alternate embodiment having five circular-shaped tiers. In particular, FIGS. 5 and 6 depict an impact protection panel 200 that includes a base portion 202 and an elevated portion 204. Base portion 202 includes substantially planar top and bottom surfaces 218 and 220, respectively. Elevated portion 204 is surrounded by and projects outward from top surface 218 of base portion 202. Elevated portion 204 includes a plurality of circular-shaped tiers or steps 206, 208, 210, 212 and 214 projecting outward from base portion 202 and culminating in a substantially planar elevated surface 216 that is parallel to top surface 218. Each circular-shaped tier has a smaller diameter than the one beneath it. Elevated surface 216 is disc-shaped and has a surface area that is smaller than the surface area of top surface 218 of base portion 202.

Figure 7:
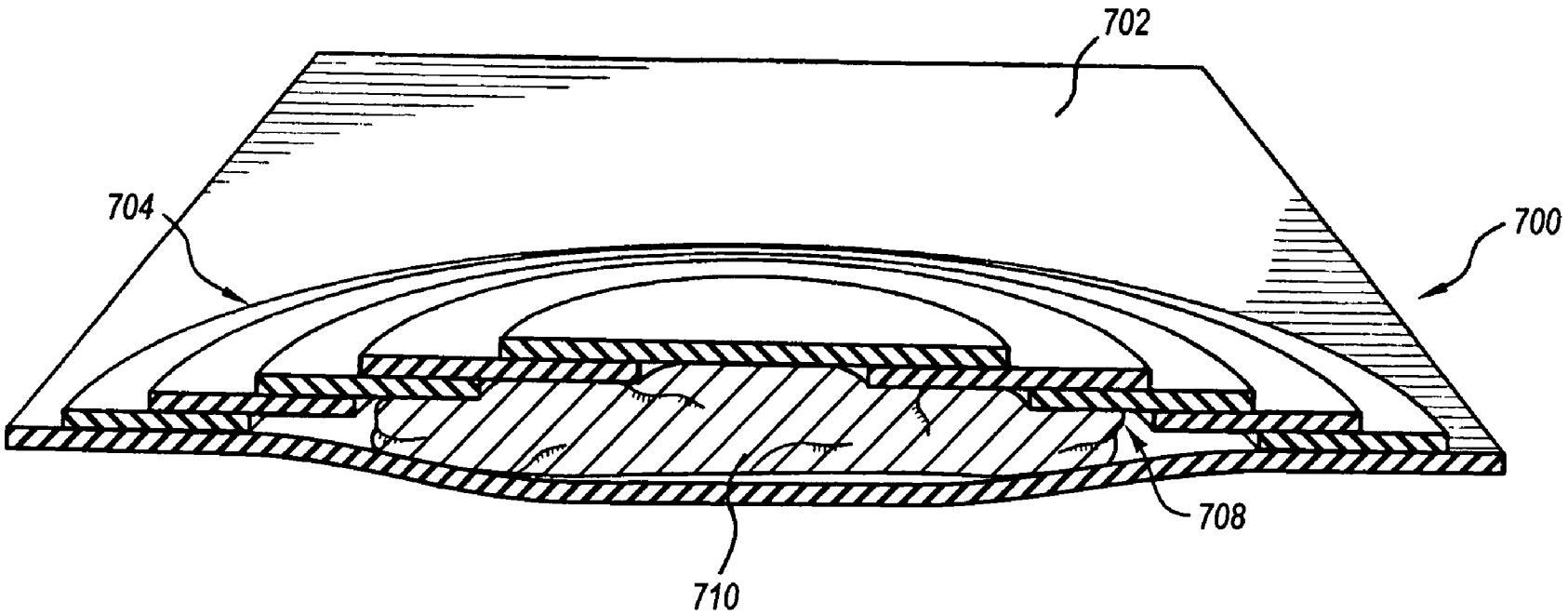
FIG. 7 is a cross-sectional top perspective view of an impact protection panel for use in a carrying case in accordance with an embodiment of the present invention.

FIG. 7 provides a cross-sectional top perspective view of an impact protection panel 700 for use in a carrying case in accordance with an alternate embodiment of the present invention. Like the previously-described embodiments, impact protection panel includes a base portion 702 having substantially planar top and bottom surfaces and an elevated portion 704 surrounded by and projecting outward from base portion 702, wherein elevated portion 704 includes a plurality of circular tiers culminating in a substantially planar elevated surface. However, in contrast to the previously-described embodiments, in impact protection panel 700, base portion 702 extends underneath the entirety of elevated portion 704, thereby defining a cavity 708 between the top surface of base portion 702 and a bottom surface of elevated portion 704. As shown in FIG. 7, a cushion 710 is disposed within the cavity 708 to increase the overall impact resistance of panel 700. In an embodiment, cushion 710 is composed of foam or other impact resistant material.

Figure 8:
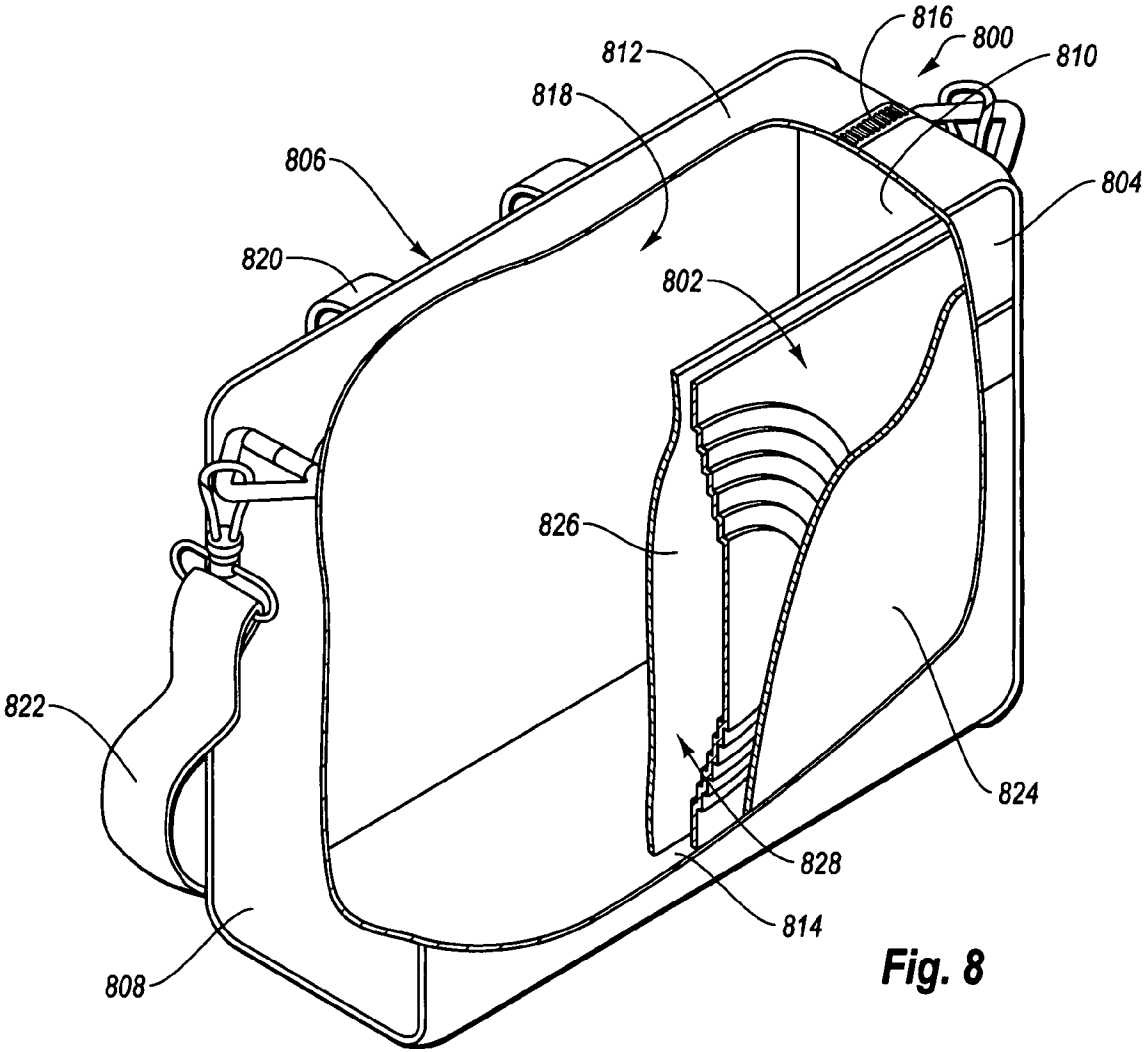
FIG. 8 is a cut-away view, in perspective, of a carrying case having an impact protection panel disposed therein in accordance with an embodiment of the present invention.
Figure 9B:
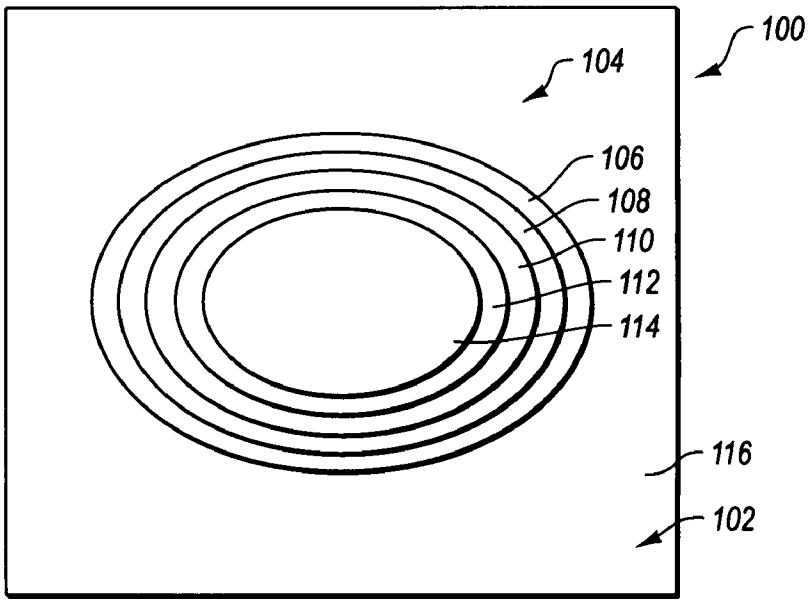
FIG. 9B is a top view of another alternative impact protection panel for use in a carrying case in accordance with an embodiment of the present invention.
Figure 9A:
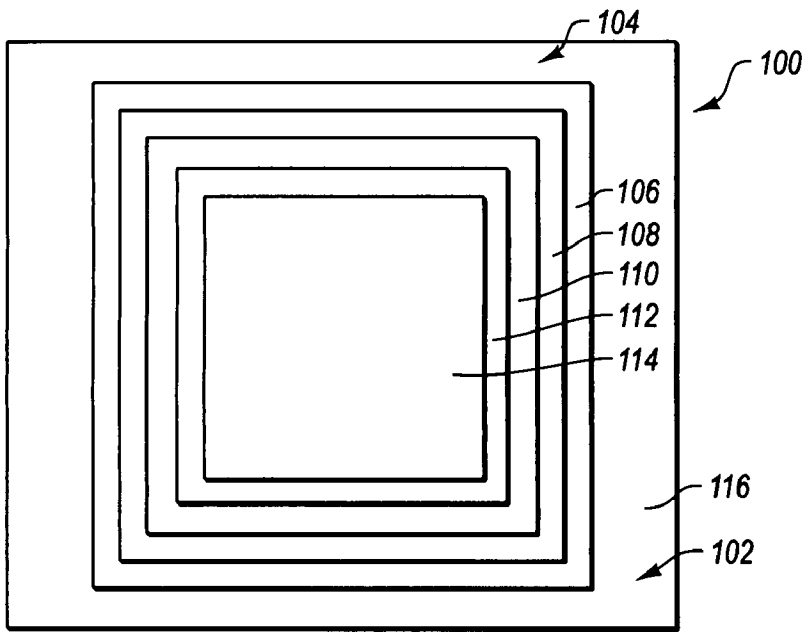
FIG. 9A is a top view of an alternative impact protection panel for use in a carrying case in accordance with an embodiment of the present invention.

FIG. 8 is a cut-away view, in perspective, of a carrying case 800 having an impact protection panel 802 disposed therein in accordance with an embodiment of the present invention. As shown in FIG. 8, carrying case 800 has an exterior that includes a front side wall 804 opposing a back side wall 806, left and right opposing side walls 808 and 810, and top and bottom side walls 812 and 814. The top, bottom, left and right side walls extend between front side wall 804 and back side wall 806 to form a generally rectangular frame with a zippered opening 816 substantially intermediate the front and back edges of the left, right and top side walls to selectively close or open carrying case 800 to allow access to an interior thereof. Preferably, at least one handle 820 is attached to front side wall 804, back side wall 806 or top side wall 812 forming an elevated loop for grasping with one hand to transport carrying case 800, and an attachable/detachable elongate, flexible webbing shoulder strap 822 is optionally included for ease of carry.

Carrying case 800 is preferably fabricated of leather, fabric or a synthetic fabric such as polyester or ballistic nylon and includes padded stiffening panels encased by the fabric material forming the outer covering.

The interior of carrying case 800 includes two elongate substantially planar partitions 824 and 826 which run parallel to exterior front and back side walls 804 and 806. Partition 826 functions as a side wall to an interior storage compartment 818. In particular, when carrying case 800 is in the closed condition shown in FIG. 8, partition 826, back side wall 806, left and right side walls 808 and 810, and top and bottom side walls 812, 814 cooperate to define the boundaries of an enclosed storage compartment 818 which is adapted for receiving a laptop, notebook or sub-notebook sized portable computer (not shown) or other delicate instrument or object, for transportation or storage.

Partitions 824 and 826 also define an interior compartment 828 situated between interior storage compartment 818 and exterior front side wall 804. Compartment 828 is adapted to house an impact protection panel 802, the design of which has been described elsewhere herein. As shown in FIG. 8, impact protection panel 802 is inserted within compartment 828 so that a bottom surface of a base portion of panel 802 faces into case so that it may rest against a flat surface of a portable computer or other delicate instrument or object stored therein while a top surface of the base portion faces out of the carrying case. When a side impact to the case occurs, the force of the impact is first received by an elevated surface of an elevated portion of panel 802 and then, due to the design of impact protection panel 802, is distributed through the tiers of the elevated portion and throughout the base portion before impacting the portable computer itself.

In an embodiment, impact protection panel 802 is permanently disposed within compartment 828. For example, during manufacturing of case 800, impact protection panel 802 may be inserted between partitions 824 and 826 and the partitions may be sewn or otherwise permanently affixed together to seal off compartment 828. In an alternate embodiment, compartment 828 includes an opening so that an end user may insert and remove impact protection panel 802 into and out of compartment 828 as desired.

Although the embodiment depicted in FIG. 8 depicts impact protection panel 802 inserted into compartment 828 defined by partitions 824 and 826, an impact protection panel can be situated in other ways within a carrying case to perform an impact protection function in accordance with the present invention. For example, an impact protection panel could be inserted into a compartment that is defined by a single partition within a carrying case and an exterior side wall. Alternatively, an impact protection panel could be simply disposed between a portable computer or other instrument or object within a carrying case and an external side wall of the case. These examples are not intended to be limiting and persons skilled in the relevant art(s) will appreciate that other configurations may be used that are within the scope and spirit of the present invention.

In an alternative embodiment of the present invention (not shown), multiple impact protection panels may be used to protect more than one side wall of a carrying case. For example, a first impact protection panel could be inserted between a front side wall of a carrying case and an interior storage compartment and a second impact protection panel could be inserted between an opposing back side wall of the carrying case and the interior storage compartment, thereby protecting a portable computer or other instrument or object stored within the interior storage compartment from both front and back side wall impacts.

While various embodiments of the present invention have been described above, it should be understood that they have been presented by way of example only, and not limitation. It will be understood by those skilled in the relevant art(s) that various changes in form and details may be made therein without departing from the spirit and scope of the invention as defined in the appended claims. Accordingly, the breadth and scope of the present invention should not be limited by any of the above-described exemplary embodiments, but should be defined only in accordance with the following claims and their equivalents.

What is claimed is:

1. A carrying case for a portable computer, comprising:

an interior storage compartment configured for receiving a portable computer;

a first impact protection panel positioned adjacent to a first sidewall of the carrying case; and a second impact protection panel positioned adjacent to a second sidewall of the carrying case, wherein the first sidewall is on the opposite side of the second sidewall, and wherein both the first and second protection panels comprise:

a base portion having substantially planar top and bottom surfaces; and an elevated portion surrounded by and projecting outward from the top surface of the base portion, the elevated portion including a substantially planar elevated surface that is substantially parallel to the top surface of the base portion, wherein the elevated portion of the first protection panel is oriented towards the first sidewall and away from the interior storage compartment, and wherein the elevated portion of the second protection panel is oriented towards the second sidewall and away from the interior storage compartment.

2. The carrying case of claim 1, wherein the elevated surface has a surface area that is smaller than a surface area of the top surface of the base portion.

3. The carrying case of claim 1, wherein the elevated portion further includes a plurality of tiers extending from the top surface of the base portion to the elevated surface.

4. The carrying case of claim 3, wherein each of the plurality of tiers is circular-shaped.

5. The carrying case of claim 3, wherein each of the plurality of tiers is square-shaped.

6. The carrying case of claim 3, wherein each of the plurality of tiers is oval-shaped.

7. The carrying case of claim 1, wherein the impact protection panels comprise plastic.

8. The carrying case of claim 1, wherein the impact protection panels comprise foam.

9. The carrying case of claim 1, wherein the impact protection panels comprise a polyvinyl chloride (PVC) compound.

10. The carrying case of claim 1, wherein both of the impact protection panels further comprise:

a cushion disposed within a cavity formed between the top surface of the base portion and a bottom surface of the elevated portion.

11. A carrying case, comprising:

an exterior including a substantially planar exterior side wall;

an interior storage compartment including a substantially planar interior side wall that is substantially parallel to the exterior side wall; and an impact protection panel disposed between the interior side wall and the exterior side wall, the impact protection panel including (i) a base portion having substantially planar top and bottom surfaces that are substantially parallel to the exterior side wall and the interior side wall, and (ii) an elevated portion surrounded by and projecting outward from the top surface of the base portion in the direction of the exterior side wall and away from the interior storage compartment, the elevated portion including a substantially planar elevated surface that is substantially parallel to the top surface of the base portion.

12. The carrying case of claim 11, wherein the elevated surface has a surface area that is smaller than a surface area of the top surface of the base portion.

13. The carrying case of claim 11, wherein the elevated portion further includes a plurality of tiers extending from the top surface of the base portion to the elevated surface.

14. The carrying case of claim 13, wherein each of the plurality of tiers is circular-shaped.

15. The carrying case of claim 13, wherein each of the plurality of tiers is square-shaped.

16. The carrying case of claim 13, wherein each of the plurality of tiers is oval-shaped.

17. The carrying case of claim 11, wherein the impact protection panel is composed of plastic.

18. The carrying case of claim 11, wherein the impact protection panel is composed of foam.

19. The carrying case of claim 11, wherein the impact protection panel is composed of a polyvinyl chloride (PVC) compound.

20. The carrying case of claim 11, wherein the impact protection panel further includes a cushion disposed within a cavity formed between the top surface of the base portion and a bottom surface of the elevated portion.

21. The carrying case of claim 11, wherein the impact protection panel is disposed within a sealed compartment located between the interior side wall and the exterior side wall.

22. A carrying case, comprising:

an exterior including a substantially planar exterior side wall;

an interior storage compartment including a substantially planar interior side wall that is substantially parallel to the exterior side wall; and an impact protection panel disposed between the interior side wall and the exterior side wall, the impact protection panel including (i) a base portion having substantially planar top and bottom surfaces that are substantially parallel to the exterior side all and the interior side wall, and (ii) an elevated portion surrounded by and projecting outward from the top surface of the base portion in the direction of the exterior side wall and away from the interior storage compartment.

* * * * *

UNITED STATES PATENT AND TRADEMARK OFFICE

CERTIFICATE OF CORRECTION

PATENT NO. : 7,216,763 B2
APPLICATION NO. : 10/983623
DATED : May 15, 2007
INVENTOR(S) : Todd Michael Gormick et al.

It is certified that error appears in the above-identified patent and that said Letters Patent is hereby corrected as shown below:

Column 3, line 10, "...elements. The drawings in which..." change to -- elements. The drawing in which --

Column 3, line 43, "...surface 116 of base portion ..." change to -- surface 118 of base portion --

Column 3, line 45, "...face 116 of base portion ..." change to -- face 118 of base portion --

Column 3, line 47, "...surface 116 of base portion ..." change to -- surface 118 of base portion --

Column 4, line 4, "...shown in FIG. 1-4. Alternatively, elevated..." change to -- shown in FIGS. 1-4. Alternatively, elevated --

Column 4, line 57, "...protection panel includes a ..." change to -- protection panel 700 includes a --

Column 5, line 45, "...faces into case so that..." change to -- faces into the carrying case so that --

Column 8, line 33, "...exterior side all and the ..." change to --exterior side wall and the --

Signed and Sealed this

Eighth Day of April, 2008

JON W. DUDAS
*Director of the United States Patent and Trademark Office*